US010438449B2

(12) United States Patent
Triplett

(10) Patent No.: US 10,438,449 B2
(45) Date of Patent: Oct. 8, 2019

(54) GAME SYSTEM AND METHOD UTILIZING OUTCOMES OF LIVE EVENTS, INCLUDING SPORTING EVENTS

(71) Applicant: Wayne Triplett, Shoreline, WA (US)

(72) Inventor: Wayne Triplett, Shoreline, WA (US)

( * ) Notice: Subject to any disclaimer, the term of this patent is extended or adjusted under 35 U.S.C. 154(b) by 0 days.

(21) Appl. No.: 15/870,696

(22) Filed: Jan. 12, 2018

(65) Prior Publication Data

US 2018/0204417 A1 Jul. 19, 2018

Related U.S. Application Data

(60) Provisional application No. 62/446,231, filed on Jan. 13, 2017.

(51) Int. Cl.
*G07F 17/38* (2006.01)
*G07F 17/32* (2006.01)

(52) U.S. Cl.
CPC ..... *G07F 17/3276* (2013.01); *G07F 17/3244* (2013.01); *G07F 17/3288* (2013.01); *G07F 17/38* (2013.01)

(58) Field of Classification Search
CPC ..... G07F 17/3276; G07F 17/3244; G07F 17/3288; G07F 17/38
USPC ..... 463/25
See application file for complete search history.

(56) References Cited

U.S. PATENT DOCUMENTS 4,084,823 A 4/1978 Haggedal
4,883,636 A * 11/1989 Fantle, Jr. ..... A63F 3/00031 273/269
5,186,461 A 2/1993 Tucker
5,683,090 A * 11/1997 Zeile ..... A63F 3/0645 273/139
7,232,128 B2 6/2007 Laporte
D610,205 S * 2/2010 Cruze ..... D21/377
2003/0224847 A1* 12/2003 Jaimet ..... A63F 3/06 463/16
2005/0098950 A1* 5/2005 Yamaguchi ..... A63F 3/0615 273/269
2010/0017126 A1 1/2010 Holcman et al.
2010/0027354 A1 2/2010 Matsui et al.
2011/0287823 A1* 11/2011 Guinn ..... G07F 17/3258 463/19

FOREIGN PATENT DOCUMENTS

WO 199609098 A1 3/1996

* cited by examiner

*Primary Examiner* — Allen Chan
(74) *Attorney, Agent, or Firm* — FisherBroyles, LLP; Rob L. Phillips

(57) ABSTRACT

A bingo-like game system and method utilizing bingo-like game cards depicting a grid formed of a plurality of spaces identifying outcomes associated with a live event such as a football game. A game system comprises a series of unique game cards with each game card depicting a grid formed of a plurality of spaces wherein the spaces identify outcomes associated with a live sporting event. Real time outcomes associated with the live sporting event dictate which matching spaces on the unique game cards are marked automatically or manually. Pre-established patterns of marked spaces determine winners of the game. The system further generates game cards having similar odds of winning based on the arrangement of possible outcomes associated with the live event.

14 Claims, 8 Drawing Sheets

GAME SYSTEM AND METHOD UTILIZING OUTCOMES OF LIVE EVENTS, INCLUDING SPORTING EVENTS

CROSS REFERENCE

This application claims priority to U.S. Application No. 62/446,231 filed Jan. 13, 2017 which is incorporated herein by reference for all purposes.

FIELD OF THE INVENTION

The embodiments of the present invention relate to a bingo-like game system and method utilizing bingo-like game cards depicting a grid formed of a plurality of spaces identifying outcomes associated with a live event (e.g., football game).

BACKGROUND

Bingo is a game created hundreds of years ago. Bingo is often played as a means for raising money for charity or as a form of gambling. While bingo is popular, the game has not changed significantly since its inception. Bingo can become tedious when a player's bingo numbers are not being called or drawn.

Thus, it would be advantageous to develop a bingo-like game that adds excitement and entertains players regardless of the game outcome.

SUMMARY

Accordingly, the embodiments of the present invention seek to add excitement to traditional bingo by integrating live events, namely sporting events, into the game.

One embodiment of the present invention relates to an electronic game system comprising: a game server having a processor running executable instructions; a storage device in communication with said game server, said storage device maintaining a series of unique virtual game cards, each virtual game card depicting a grid formed of a plurality of spaces wherein each of said spaces identify a possible outcome associated with a live sporting event; multiple gaming devices configured to communicate with said game server to play a game of chance using said virtual game cards in combination with outcomes of said live sporting event; a substantially real-time feed of outcomes associated with said live sporting event; and wherein said processor causes spaces on said virtual game cards to be marked responsive to an outcome of said live sporting event matching said possible outcomes identified by said spaces.

Another embodiment of the present invention relates to a game system comprising: a series of unique game cards, each game card depicting a grid formed of a plurality of spaces wherein said spaces identify possible outcomes associated with a live sporting event; a live feed of said live sporting event for determining outcomes associated with said live sporting event; and marking apparatuses for marking spaces on said game cards responsive to an outcome of said live sporting event matching said possible outcomes identified by said spaces.

Another embodiment of the present invention relates to an electronic game system comprising: a game server having a processor running executable instructions; a storage device in communication with said game server, said storage device maintaining a series of unique virtual game cards, each virtual game card depicting a grid formed of a plurality of spaces wherein each of said spaces identify a possible outcome associated with a football game; a software application configured to generate said unique virtual game cards with odds of winning within a defined range, said software application maintaining odds of winning within said defined range based on arrangements of said possible outcomes on each unique virtual game card associated with said football game; multiple gaming devices configured to communicate with said game server to play a game of chance using said virtual game cards in combination with outcomes of said football game; a substantially real-time feed of outcomes associated with said football game; and wherein said processor causes spaces on said virtual game cards to be marked responsive to an outcome of said football game matching said possible outcomes identified by said spaces.

The embodiments of the present invention are suitable for live play, electronic play and online play as described below.

Other variations, embodiments and features of the present invention will become evident from the following detailed description, drawings and claims.

DETAILED DESCRIPTION

Figure 1:
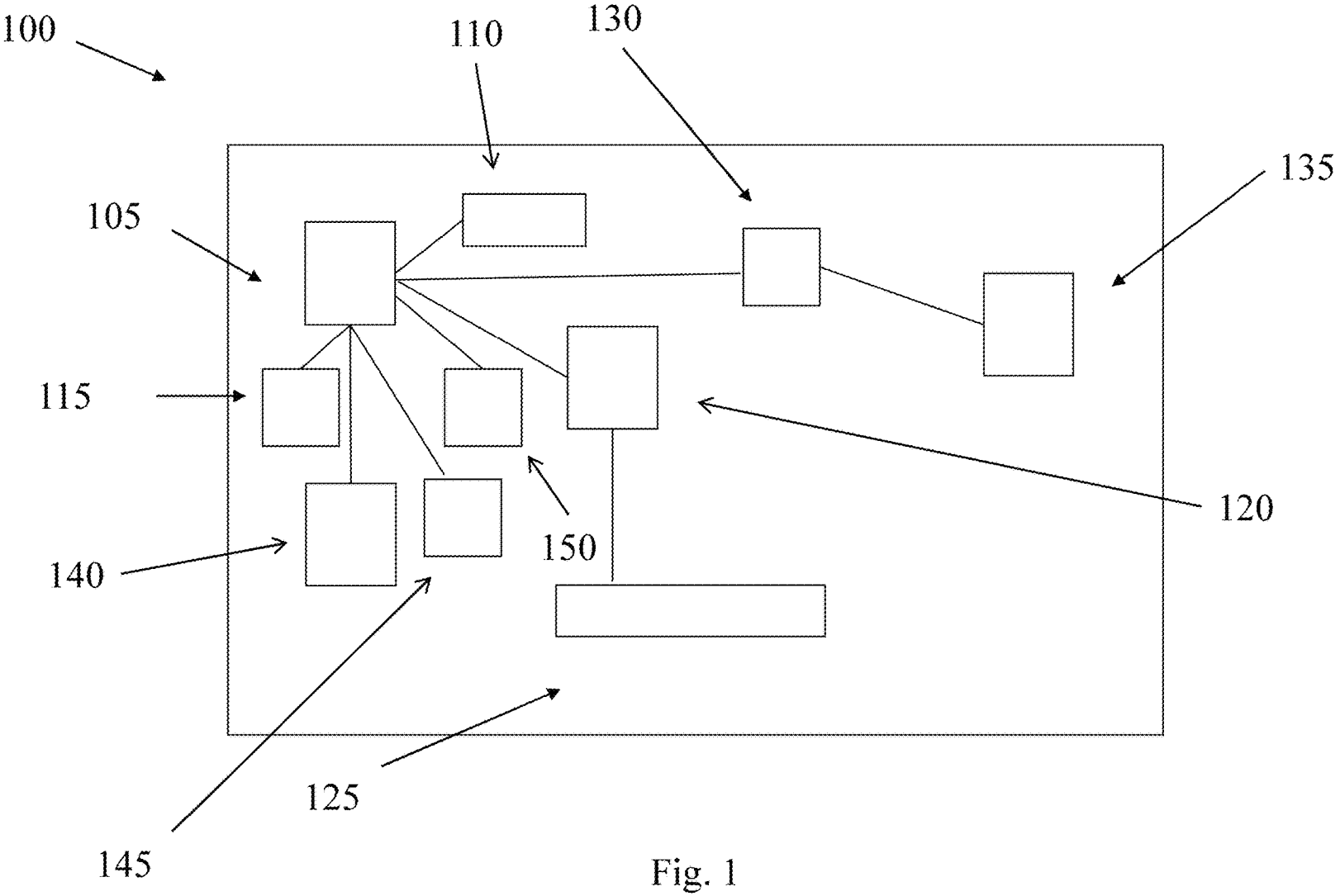
FIG. 1 illustrates a block diagram of an electronic gaming machine of the type which may facilitate electronic embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the virtual, digital and online embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming device" and "gaming machine" should be understood to be any one of a general purpose computer, as for example a personal computer or a laptop computer, a client computer configured for interaction with a server, a special purpose computer such as a server, or a smart phone, tablet computer, personal digital assistant or any other machine adapted for executing programmable instructions in accordance with the description thereof set forth herein.

In addition to live environments where the disclosed bingo-like game is played using physical, tangible game cards, the embodiments of the present invention may be facilitated by a mobile electronic gaming device network whereby multiple players play against one another under the control of a central game server as described herein. Also, besides mobile electronic devices, multiple electronic gaming devices in the form of standalone gaming devices/machines and/or bar-top devices/machines may form a gaming device/machine network for conducting a game according to the embodiments of the present invention.

A block diagram of the electronic gaming device 100 is shown in FIG. 1. The exemplary electronic gaming device 100 may include a central processing unit (CPU) also deemed a processor 105 which controls the electronic gaming device 100 based on instructions stored in program read-only memory (ROM) 110 and pay table ROM 115. Program ROM 110 stores executable instructions related to the operation of the gaming device 100 which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming device 100 may be linked to a central game server which allows players to select from a number of games via the electronic gaming device 100. In such an embodiment, one or more processors integrated into the central server control the gaming device 100 based on instructions stored in program ROM 110.

A user interface 140 may respond to buttons on button panel or display incorporating touch screen technology or any other devices providing means for users to communicate with, and instruct, the electronic gaming device 100. Wager memory 145 stores an amount of money/credits deposited into the electronic gaming device 100 by a player and specific wager information related to each play of the electronic gaming device 100. Payout system 150 includes a coupon printer or similar device for receiving money/coupon from the electronic gaming device 100.

Those skilled in the art will recognize that the configuration and features of the electronic gaming device 100 disclosed herein are exemplary and may be altered in any number of ways without impacting the embodiments of the present invention.

Figure 2:
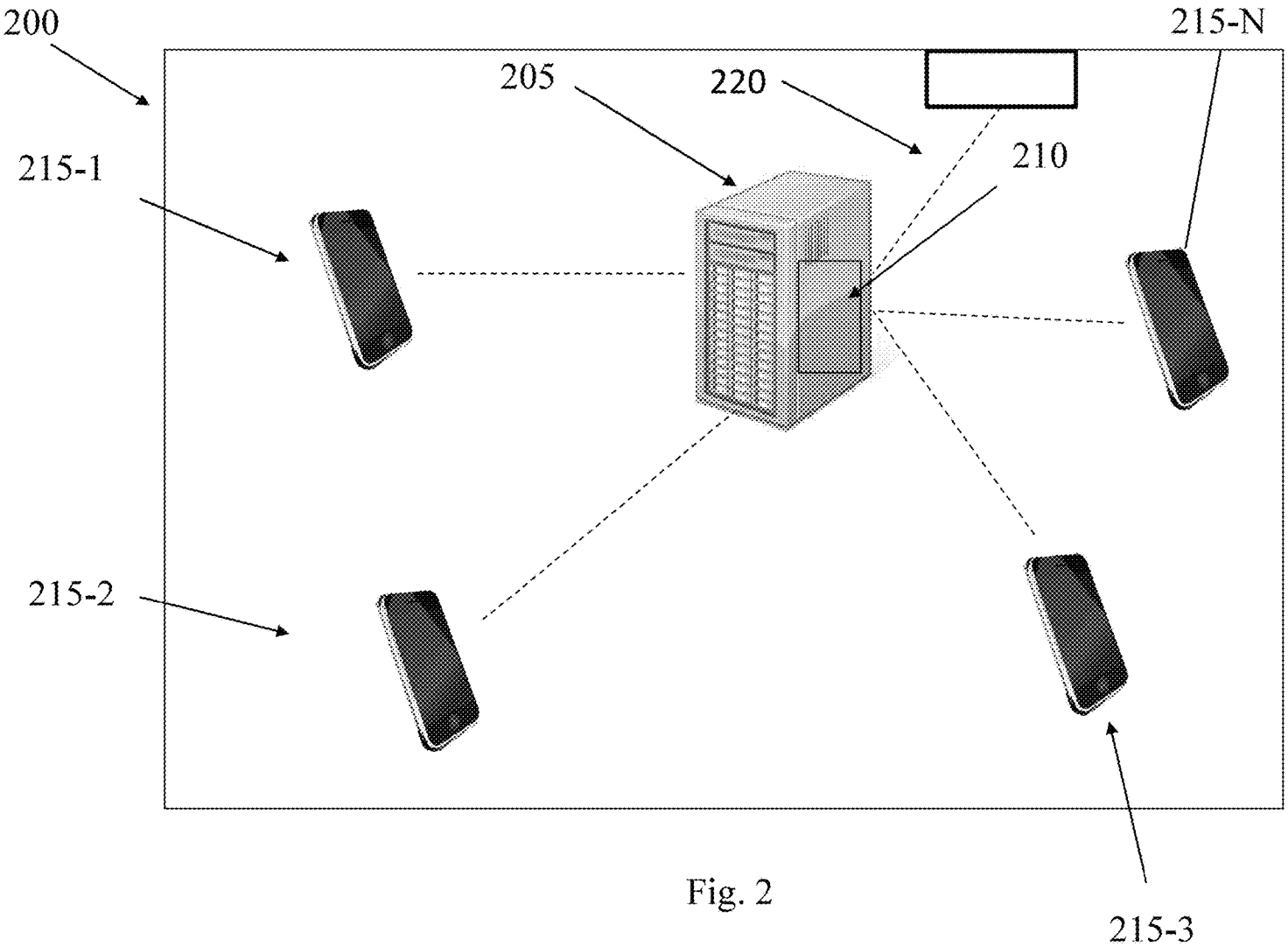
FIG. 2 illustrates a block diagram of a wireless mobile device network which may be used to facilitate remote play of the game according to the embodiments of the present invention.

FIG. 2 shows a block diagram of a wireless mobile device network 200 which may be used to facilitate remote play of the game according to the embodiments of the present invention. With this embodiment, a software application ("App") is downloaded to smart phones or tablets and playable via processing power and a user interface associated therewith. The wireless network 200 comprises a game server 205, including one or more processors 210 running game software, and remote smart devices 215-1 through 215-N (e.g., smart phones) configured to access said game server 205 facilitating game play on the remote devices 215-1 through 215-N. Players play the game using the touchscreen associated with the remote devices 215-1 through 215-N. A communication link 220 provides game server 205 and/or remote devices 215-1 through 215-N with real-time game outcomes associated with a subject live event (e.g., football game). The real-time game outcomes can be received via a subscription service with a third party (e.g., FantasyData, LLC) providing such a service. Nevada sportsbooks subscribe to such services to keep sports bettors apprised of game scores and status.

Figure 3:
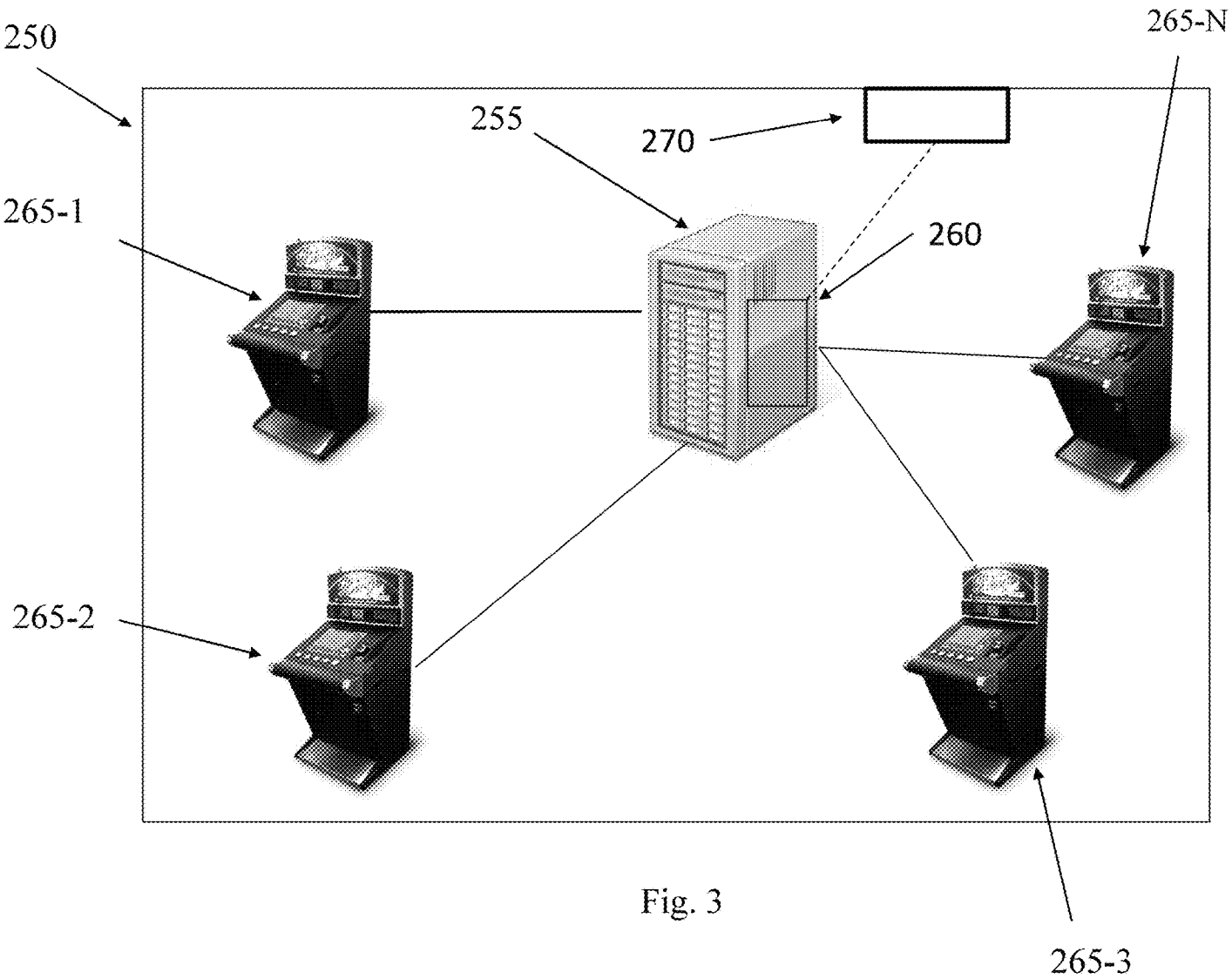
FIG. 3 illustrates a block diagram of a gaming device/machine network which may be used to facilitate remote play of the game according to the embodiments of the present invention.

FIG. 3 shows a block diagram of a gaming machine network 250 which may be used to facilitate local play of the game according to the embodiments of the present invention. The network 250 comprises a game server 255, including one or more processors 260 running game software/program, and gaming machines 265-1 through 265-N in wired (or wireless) communication with said game server 255 facilitating game play on the gaming machines 265-1 through 265-N. The gaming machines 265-1 through 265-N are configured generally as set forth in FIG. 1. A communication link 270 provides game server 255 and/or gaming machines 265-1 through 265-N with real-time game outcomes associated with a subject live event (e.g., football game).

While the embodiments of the present invention may be played using various live events including sporting events, for the sake of brevity, the description herein focuses on live National Football League ("NFL") football games.

In a live embodiment, physical game cards are fabricated of two pieces of game board stock, book cover stock or the like sandwiching pieces of slidable, tinted material (e.g., plastic) used by players to mark game card spaces as needed. Alternatively, the game cards may be printed on paper and players may use ink daubers, coins or other articles to mark game card spaces as needed.

Figure 4:
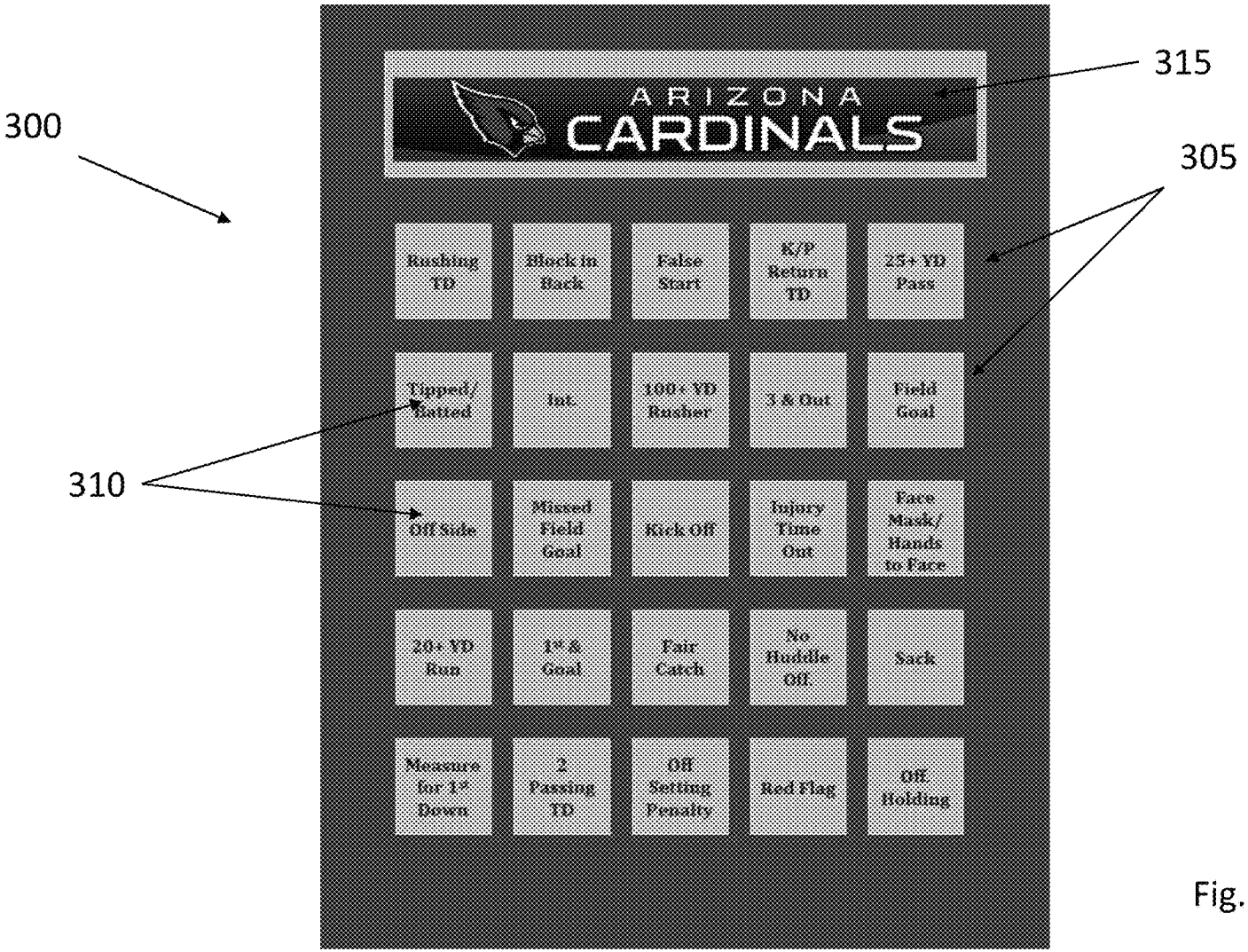
FIG. 4 illustrates an exemplary game card according to the embodiments of the present invention.

FIG. 4 shows an exemplary game card 300 of the type useable with the embodiments of the present invention. The game card 300 depicts a 5×5 grid comprising 25 spaces 305 each depicting a possible football game outcome 310. A back of the card (not shown) may depict game instructions. In one embodiment, the center space is a free space depicting a kickoff outcome—every football game starts with a kickoff. A game card pack comprises a plurality of unique game cards of the type distributed to players. The uniqueness of the game cards in the game card pack may involve randomly selecting possible football game outcomes from a pool of such outcomes and placing the selected football game outcomes on the game card spaces. Regardless of the manner in which the game cards are rendered unique, each game card should have the same basic odds of winning (i.e., within a defined range (e.g., 10%)) based on the possible football game outcomes selected for each card. Game odds for each game card can be generally matched by understanding the odds of each possible football outcome occurring (e.g., a safety is much less likely than a first down) and ensuring that no game card has potential winning patterns populated with harder-to-achieve game outcomes or easier-to-achieve game outcomes than the other game cards. A software application may generate game cards to prevent any game cards from falling outside of an acceptable threshold of winning compared to the other created game cards. The software application may also be used to analyze game cards generated by randomly assigning outcomes to spaces of each game card.

The game cards may be tracked using bar codes, QR codes or similar means. The codes may also be used to verify winning cards.

As shown in FIG. 4, game cards 300 may use licensed content 315 (e.g., NFL team names, logos and/or colors) or custom content to further enhance the attractiveness of the game and to identify which football game outcomes relate to the subject game card.

In one embodiment, a NFL game pack includes one or more game cards for each of the 32 NFL teams. In one embodiment, there are 44 potential football game outcomes that may randomly appear on the 25 spaces of each game card. With 25 spaces per game card and 44 possible game outcomes, the odds of a player obtaining a pre-established winning pattern can be set high. Increasing or decreasing the number and likelihood of possible game outcomes and/or including game outcomes associated with the home team only or visiting team only allow the game odds to be adjusted as desired. Table 1 lists one set of exemplary football game outcomes which may be used to randomly populate game cards. In one embodiment, each game card is configured to achieve at least one winning outcome (e.g., five spaces in a row marked) by positioning certain higher percentage football game outcomes along one row (or other spaces corresponding to a pre-established game winning outcome (e.g., four corners)).

TABLE 1

| | | |
|---|---|---|
| Rushing TD | Missed Field Goal | Red Challenge Flag |
| Two Rushing TDs | Fumble | Measure for First Down |
| Passing TD | Interception | $1^{st}$ and Goal |
| Two Passing TDs | Offensive Holding | QB Keeper |
| Sack | Defensive Holding/Pass Interference | No Huddle Offense |
| Two Sacks | Illegal Contact/Defensive Penalty | Go for it on $4^{th}$ Down |
| False Start | Injury Timeout | Missed PAT |
| Off Sides | Roughing Passer | Safety/Onside Kick |
| 20+ Yard Run | 3 and Out | Score 30+ Points |
| 25+ Yard Pass | Punt Inside 10 Yard Line | 12 Men on Field |
| 100+ Yard Rusher | Block in Back | Facemask/Hands to Face |
| 100+ Yard Receiver | Tipped Ball/Batted Ball | Hail Mary/Flee-Flicker |

TABLE 1-continued

| | | |
|---|---|---|
| Kick/Punt Return TD | Fair Catch | Booth Review |
| Blocked Kick/Punt | Delay of Game | Overturn TD/Timeout |
| 50+ Yard Field Goal | | |

Figure 5A:
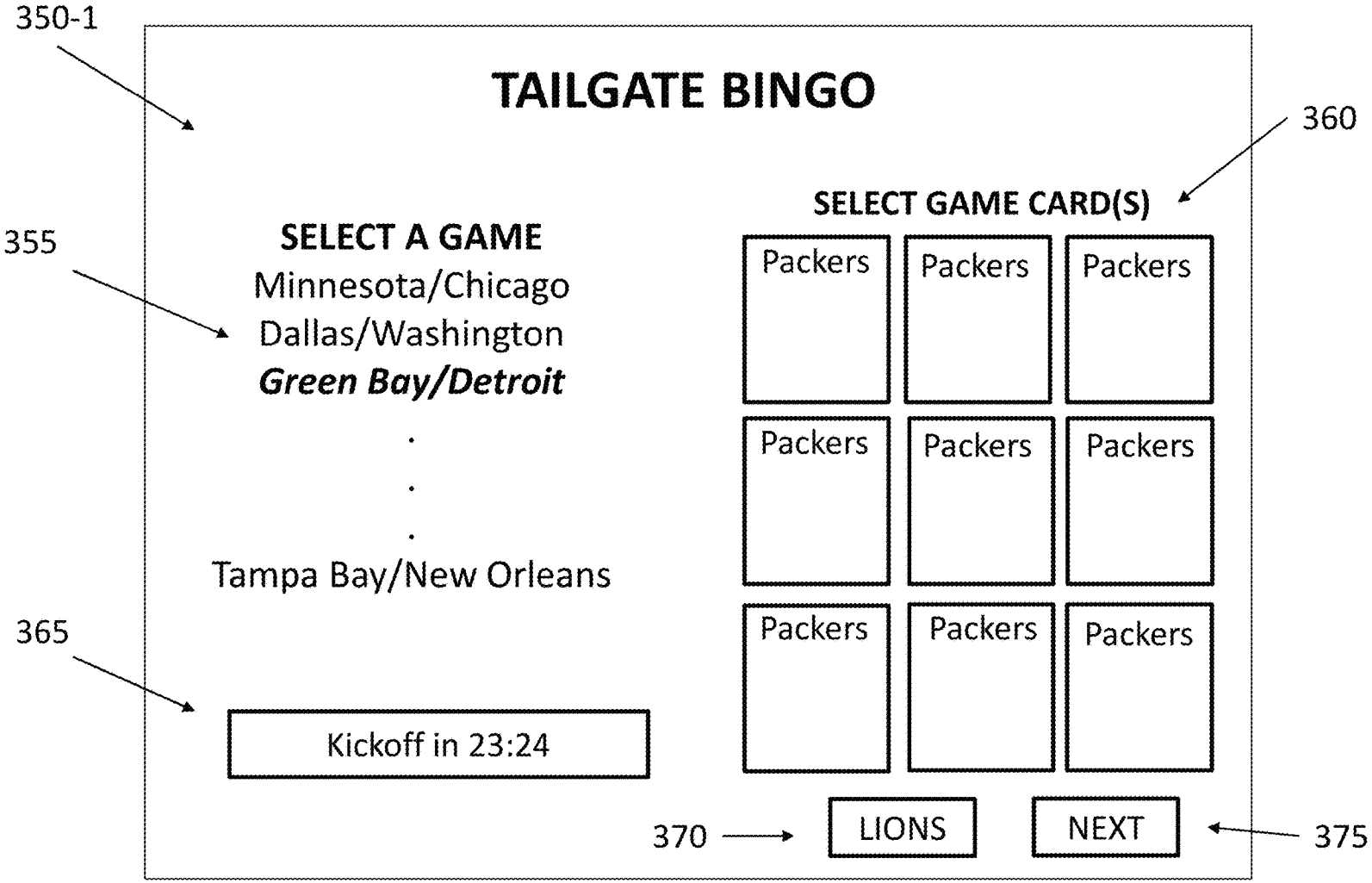
FIGS. 5A-5C illustrate a series of screen shots of an electronic or online version of the game according to the embodiments or the present invention.
Figure 5B:
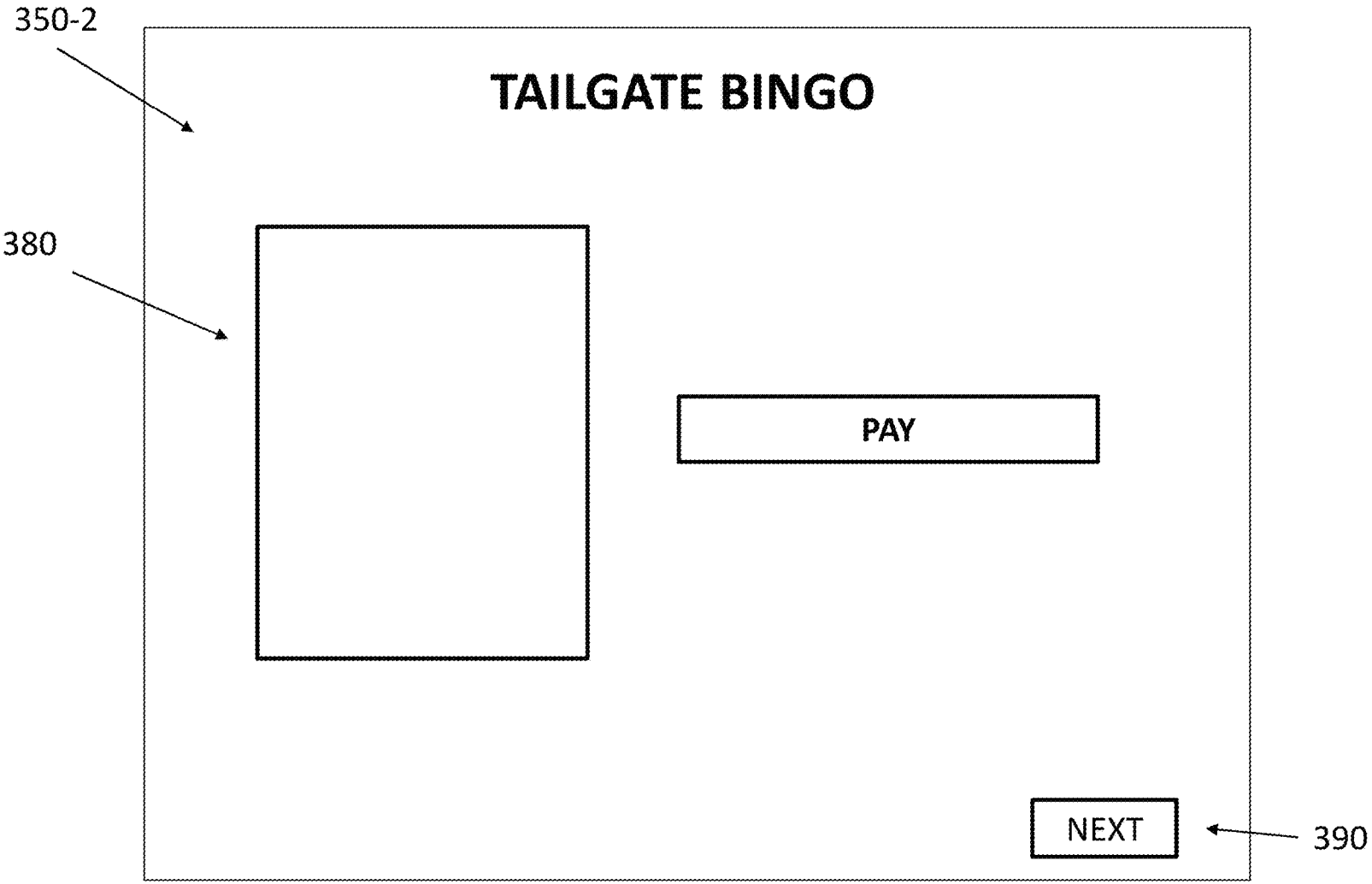
Figure 5C:
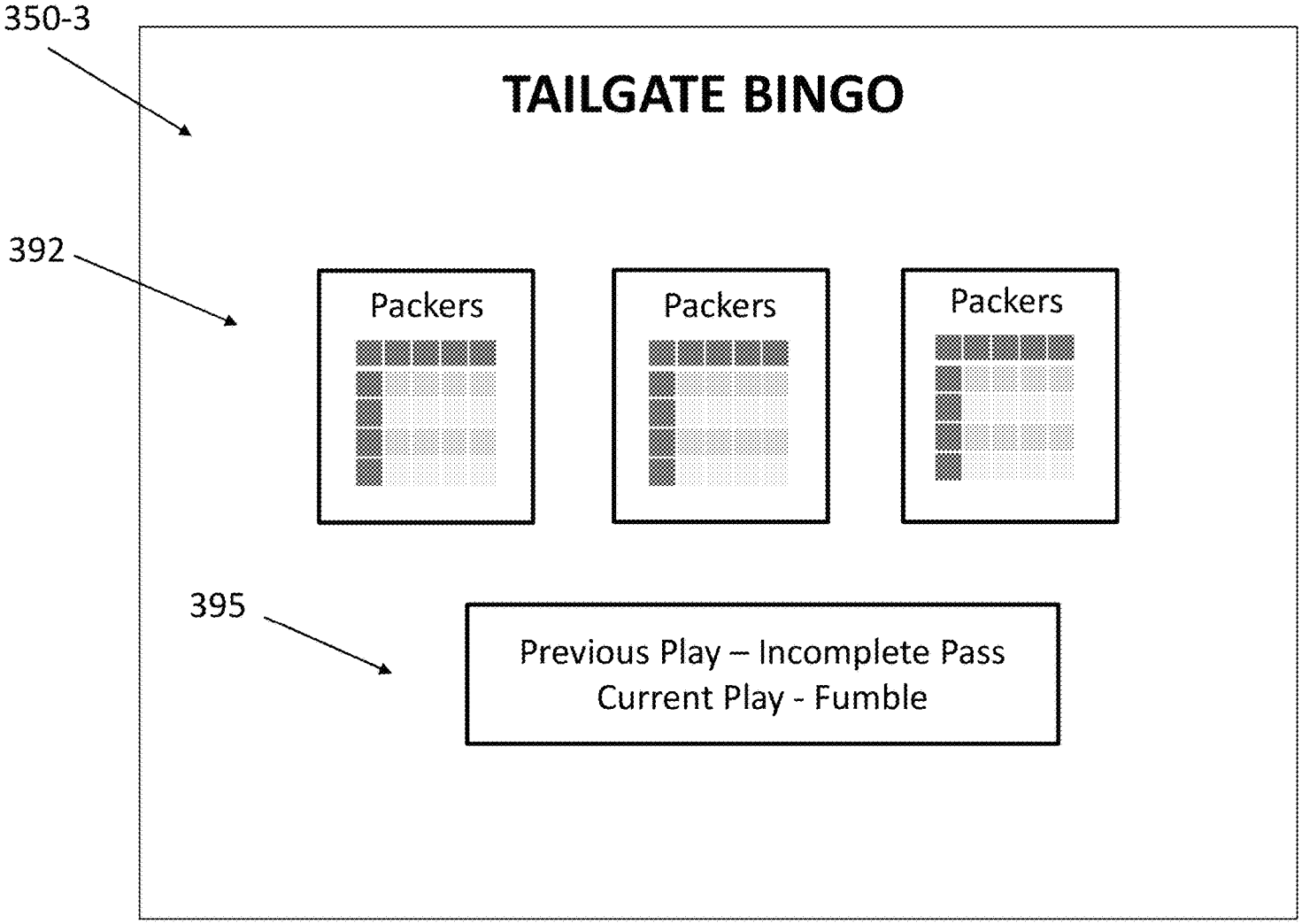

FIGS. 5A-5C shows a series of screen shots 350-1 through 350-3 of an electronic or online version of the game according to the embodiments of the present invention. Screen shot 350-1 is a home page on which registered players may select a game 355 and then one or more associated unique virtual game cards 360 to purchase (or obtain for free if the game is promotional in nature). In this instance, the Green Bay Packers-Detroit Lions game has been selected causing virtual game cards associated with the Green Bay Packers to display for selection. The player may wish to select a virtual game card associated with the LIONS via link 365. The home page may include a timer 370 counting down to the start of the selected game. A NEXT link 375 advances the player to a screen shot 350-2 depicting a payment page on which the player is able to enter payment information in information boxes 380 and pay for the selected one or more unique, virtual game cards using a PAY link 385. A NEXT link 390 advances the player to screen shot 350-3 depicting selected game cards 392. A game outcome window 395 displays real-time game outcomes which the player receives allowing the player to mark the corresponding game outcomes (i.e., touch the spaces on a touch screen) on the one or more purchased game cards. The live football game may also be displayed on the machine screen. The electronic or online system may include a game program that causes the game spaces to be automatically marked/covered responsive to the football game outcomes. A master board or list may identify all game outcomes that have occurred thus far during the football game. The master board provides a reference for players to confirm they have marked all spaces properly.

Figure 6:
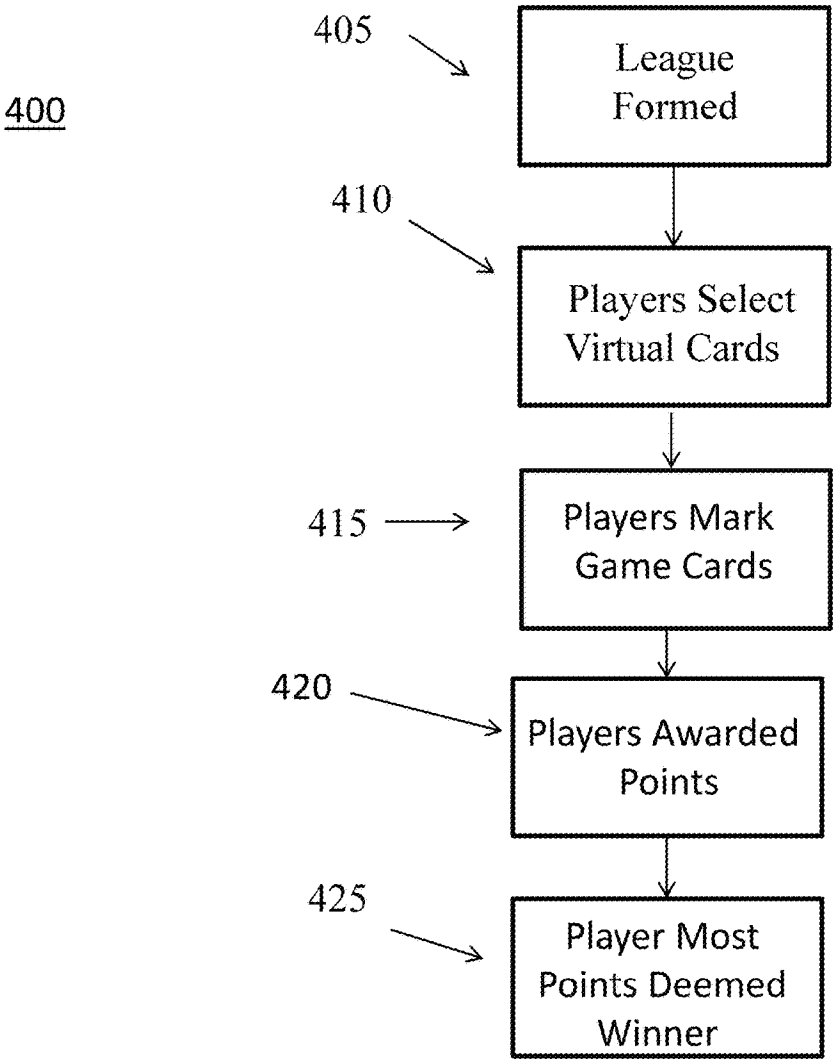
FIG. 6 illustrates a flow chart detailing one online method of conducting a game according to the embodiments of the present invention.

FIG. 6 shows a flow chart 400 detailing one online method of conducting a game according to the embodiments of the present invention. At 405, up to 32 players form a league similar to a fantasy sports league. At 410, each player selects a virtual game card for each game on the NFL schedule. A normal NFL schedule has 16 games per week but some weeks have less since certain teams have bye weeks. At 415, responsive to game outcomes of each NFL game, players (or the system) mark each game card based on game outcomes associated with the respective game card. That is, for a Denver Broncos vs. Minnesota Vikings game, each player marks their game card for that game based on game outcomes from that game and so on for each other game card and associated game. At 420, the player holding the game card achieving a first winning outcome (i.e., achieving a pre-established pattern on the game cards) for each of the NFL games is awarded one point (or some other set value). At 425, a player obtaining the most points across the 16 games is deemed the winner for the week. In one embodiment, the player holding the game card achieving the first winning outcome across all the NFL games is awarded bonus points. It is apparent that any number of scoring systems and game rules may be established within the spirit and scope of the present invention.

The embodiments of the present invention are also well-suited for a live game conducted within a Nevada sports book. In such a setting, the sports book may conduct the game as a promotion, free contest or pay-for-play contest. The sports book may distribute game cards to sports book bettors for their participation in a live version of the game based on live football games broadcast in the sports book. The first player or players achieving a winning outcome may be awarded comps, cash and/or other prizes dependent on the sports book or casino. Such a live game encourages bettors to remain in the sports book and ideally place bets.

The game described herein may be played heads up between two players with each player selecting game cards for one or more NFL games. In one embodiment, an elimination tournament (akin to NCAA basketball tournament) may be played in this manner with winning players advancing to successive rounds until only one player remains.

In another embodiment, a game is played using the game cards described above in combination with players also selecting the winners of the games. The selections may be simply the winning teams or the teams winning against a point spread. For example, with the embodiment detailed in flow chart 400 of FIG. 6, players may select a virtual game card for each game and also select the predicted winner of each game. The game is won by the player obtaining the most game winning outcomes on the game cards across the total number of games in combination with the correct number of selected game winners. In a linear example, if a player obtains 4 winning game card outcomes and predicts 12 games correctly the player has 16 points. In other embodiments, the game card outcomes and the correctly predicted winners may be weighted differently. Those skilled in the art will recognize that any number of scoring systems may be utilized. Such a game adds a skill component to the game. This embodiment is also ideal for implementation in a casino sports book where players congregate to watch and wager on the predicted outcomes of sporting events.

Although the invention has been described in detail with reference to several embodiments, additional variations and modifications exist within the scope and spirit of the invention as described and defined in the following claims.

I claim:

1. An electronic game system comprising:

a game server having a processor running executable instructions;

a storage device in communication with said game server, said storage device maintaining a series of unique virtual game cards, each virtual game card depicting a grid formed of a plurality of spaces wherein each of said spaces identify a possible outcome associated with a live sporting event, each said unique virtual game card within said series of unique virtual game cards having an arrangement of said possible outcomes associated with said live sporting event;

a software application configured to generate game cards utilizing probabilities related to each of said possible outcomes of said live sporting event ensuring that each of said unique virtual game cards includes an arrangement of said possible outcomes resulting in each unique virtual game card having odds of generating a game-winning outcome within a range of ten percent of every other unique virtual game card;

multiple gaming devices configured to communicate with said game server to play a game of chance using said virtual game cards in combination with outcomes of said live sporting event;

a substantially real-time feed of outcomes associated with said live sporting event; and wherein said processor causes spaces on said virtual game cards to be marked responsive to an outcome of said live sporting event matching said possible outcomes identified by said spaces.

2. The electronic game system of claim 1 wherein said grid is 5×5.

3. The electronic game system of claim 1 wherein said live sporting event is a football game.

4. The electronic game system of claim 1 wherein a winning player of said game of chance is a first player to hold a virtual game card with marked spaces forming a pre-established pattern.

5. The electronic game system of claim 1 wherein said processor is configured to accept fees for virtual game cards and pay awards to winning players.

6. A game system comprising:

a series of unique game cards, each game card depicting a grid formed of a plurality of spaces wherein said spaces identify possible outcomes associated with a live sporting event;

a software application configured to generate game cards utilizing probabilities related to each of said possible outcomes of said live sporting event ensuring that each of said unique virtual game cards includes an arrangement of said possible outcomes resulting in each unique virtual game card having odds of generating a game-winning outcome within a range of ten percent of every other unique virtual game card;

a live feed of said live sporting event for determining outcomes associated with said live sporting event; and marking apparatuses for marking spaces on said game cards responsive to an outcome of said live sporting event matching said possible outcomes identified by said spaces.

7. The game system of claim 6 wherein said grid is 5×5.

8. The game system of claim 6 wherein said live sporting event is a football game.

9. The game system of claim 6 wherein a winning player of said game of chance is a first player to hold a game card with marked spaces forming a pre-established pattern.

10. The game system of claim 6 further comprising a device for accepting fees for game cards.

11. An electronic game system comprising:

a game server having a processor running executable instructions;

a storage device in communication with said game server, said storage device maintaining a series of unique virtual game cards, each virtual game card depicting a grid formed of a plurality of spaces wherein each of said spaces identify a possible outcome associated with a football game;

a software application configured to generate game cards utilizing probabilities related to each of said possible outcomes of said live sporting event ensuring that each of said unique virtual game cards includes an arrangement of said possible outcomes resulting in each unique virtual game card having odds of generating a game-winning outcome within a range of ten percent of every other unique virtual game card;

multiple gaming devices configured to communicate with said game server to play a game of chance using said virtual game cards in combination with outcomes of said football game;

a substantially real-time feed of outcomes associated with said football game; and wherein said processor causes spaces on said virtual game cards to be marked responsive to an outcome of said football game matching said possible outcomes identified by said spaces.

12. The electronic game system of claim 11 wherein said grid is 5×5.

13. The electronic game system of claim 11 wherein a winning player of said game of chance is a first player to hold a virtual game card with marked spaces forming a pre-established pattern.

14. The electronic game system of claim 11 wherein said processor is configured to accept fees for virtual game cards and pay awards to winning players.

* * * * *